US009158264B2

(12) United States Patent
Iwashita et al.

(10) Patent No.: US 9,158,264 B2
(45) Date of Patent: Oct. 13, 2015

(54) ELECTROPHOTOGRAPHIC PHOTOSENSITIVE MEMBER AND IMAGE FORMING APPARATUS INCLUDING ELECTROPHOTOGRAPHIC PHOTOSENSITIVE MEMBER

(71) Applicant: Kyocera Document Solutions Inc., Osaka (JP)

(72) Inventors: Yuko Iwashita, Osaka (JP); Kazutaka Sugimoto, Osaka (JP); Junichiro Otsubo, Osaka (JP); Yukimasa Watanabe, Osaka (JP); Kazuaki Edure, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 16 days.

(21) Appl. No.: 14/068,182

(22) Filed: Oct. 31, 2013

(65) Prior Publication Data

US 2014/0120464 A1 May 1, 2014

(30) Foreign Application Priority Data

Oct. 31, 2012 (JP) ..... 2012-241394

(51) Int. Cl.

| | |
|---|---|
| ***G03G 15/00*** | (2006.01) |
| ***G03G 5/047*** | (2006.01) |
| ***G03G 5/06*** | (2006.01) |

(52) U.S. Cl.

CPC ..... *G03G 15/75* (2013.01); *G03G 5/047* (2013.01); *G03G 5/0675* (2013.01); *G03G 5/0696* (2013.01); *G03G 5/0698* (2013.01)

(58) Field of Classification Search

CPC ..... G03G 15/75; G03G 5/047; G03G 5/06; G03G 5/0612; G03G 5/0625; G03G 5/0675; G03G 5/0696

USPC ..... 430/56, 58.5, 58.75, 59.2, 59.4, 69; 399/159

See application file for complete search history.

(56) References Cited

U.S. PATENT DOCUMENTS

| | | | | |
|---|---|---|---|---|
| 5,656,407 | A | 8/1997 | Kawahara | |
| 5,821,021 | A | 10/1998 | Kawahara | |
| 6,153,344 | A * | 11/2000 | Miyamoto et al. | 430/83 |
| 2003/0211413 | A1 | 11/2003 | Lin et al. | |
| 2008/0298840 | A1 | 12/2008 | Shimada | |

FOREIGN PATENT DOCUMENTS

| | | |
|---|---|---|
| EP | 0552740 | 7/1993 |
| EP | 0632332 | 1/1995 |

(Continued)

OTHER PUBLICATIONS

European Search Report—Application No. 13191198.4, dated Jan. 30, 2014. (4 pages).

*Primary Examiner* — Thorl Chea
(74) *Attorney, Agent, or Firm* — K&L Gates LLP

(57) ABSTRACT

A single-layer-type electrophotographic photosensitive member includes a layer disposed on an electrically conductive substrate, the layer including at least a charge-generating material, an electron transport material, a hole transport material, and a binder resin within the same layer. The charge-generating material contains a phthalocyanine pigment and N-type pigments including at least a perylene-based pigment and an azo-based pigment, and the total amount of the N-type pigments is 0.03 to 10 parts by mass relative to 1 part by mass of the phthalocyanine pigment.

8 Claims, 2 Drawing Sheets

(56) References Cited

FOREIGN PATENT DOCUMENTS

| | | |
|---|---|---|
| JP | 07199493 | 8/1995 |
| JP | 2001242655 | 9/2001 |
| JP | 2002-196520 | 7/2002 |
| JP | 2006178321 | 7/2006 |
| JP | 2007-233351 | 9/2007 |
| JP | 2011158711 | 8/2011 |

* cited by examiner

ELECTROPHOTOGRAPHIC PHOTOSENSITIVE MEMBER AND IMAGE FORMING APPARATUS INCLUDING ELECTROPHOTOGRAPHIC PHOTOSENSITIVE MEMBER

INCORPORATION BY REFERENCE

This application is based upon, and claims the benefit of priority from, corresponding Japanese Patent Application No. 2012-241394 filed in the Japan Patent Office on Oct. 31, 2012, the entire contents of which are incorporated herein by reference.

FIELD

The present disclosure relates to an electrophotographic photosensitive member and an image forming apparatus including an electrophotographic photosensitive member.

BACKGROUND

As electrophotographic photosensitive members used in electrophotographic image forming apparatuses, it is known to use inorganic photosensitive members having a photosensitive layer composed of an inorganic material, such as selenium and a-silicone, and organic photosensitive members having a photosensitive layer mainly composed of organic materials, such as a binder resin, a charge-generating material, and a charge transport material. Among these photosensitive members, organic photosensitive members have been widely used because of the ease of production compared with inorganic photosensitive members, wider selectivity of materials for the photosensitive layer, and higher design freedom.

An example of such organic photosensitive members is a single-layer-type organic photosensitive member which has a photosensitive layer including at least a charge-generating material and a charge transport material within the same layer. As compared with a multilayer-type organic photosensitive member in which a charge generation layer containing at least a charge-generating material and a charge transport layer containing a charge transport material are stacked on an electrically conductive substrate, the single-layer-type organic photosensitive member is advantageous in that it has a simple structure, is easy to manufacture, and can suppress the occurrence of film defects, and thus it is widely used.

In recent years, the size of multi function peripherals and printers has been reduced and the printing speed has been increased. Accordingly, photosensitive members which are to be used in multi function peripherals and printers capable of high-speed printing are required to have higher sensitivity so as to be able to print with the high-speed process.

Conventionally, a metal-free phthalocyanine is used as a charge-generating material of the single-layer photosensitive member. However, there is a limit in achieving higher sensitivity. In contrast, an oxotitanium phthalocyanine has a higher quantum efficiency than the metal-free phthalocyanine and is a charge-generating material that is very useful in increasing the sensitivity of an electrophotographic photosensitive member.

However, when oxotitanium phthalocyanine is used in a high-speed process, charge acceptance of the electrophotographic photosensitive member degrades after repeated use, and fog, black stripes, density unevenness, and the like occurs in the resulting image. The reason for this is believed to be that, although advantages, such as high responsiveness, are achieved because the high sensitivity property of oxotitanium phthalocyanine causes a relatively large amount of charge generation, when oxotitanium phthalocyanine is used in the high-speed processes, a memory phenomenon occurs wherein a charge remains in the photosensitive layer and the difference in potential between the exposed portion and the non-exposed portion decreases.

In order to prevent the occurrence of the memory phenomenon, for example, an oxotitanium phthalocyanine and another phthalocyanine may be combined, or an oxotitanium phthalocyanine having a maximum peak at a Bragg angle ($2\theta \pm 0.2°$) of 27.2° in an X-ray diffraction spectrum and a charge transport agent may be incorporated into a photosensitive layer.

SUMMARY

According to an embodiment of the present disclosure, a single-layer-type electrophotographic photosensitive member is provided that includes a layer disposed on an electrically conductive substrate, the layer including at least a charge-generating material, an electron transport material, a hole transport material, and a binder resin within the same layer. In the photosensitive layer, the charge-generating material contains a phthalocyanine pigment and two or more N-type pigments including at least a perylene-based pigment and an azo-based pigment, and the total amount of the N-type pigments is 0.3 to 3 parts by mass relative to 1 part by mass of the phthalocyanine pigment.

According to another embodiment of the present disclosure, an image forming apparatus is provided that includes an image-supporting member, a charging device for charging a surface of the image-supporting member, an exposing device for exposing the charged surface of the image-supporting member and forming an electrostatic latent image on the surface of the image-supporting member, a developing device for developing the electrostatic latent image to form a toner image, and a transferring device for transferring the toner image from the image-supporting member to a transfer-receiving medium. The image-supporting member is the single-layer-type electrophotographic photosensitive member described above, and the charging device positively charges the image-supporting member.

Additional features and advantages are described herein, and will be apparent from the following Detailed Description and the figures.

DETAILED DESCRIPTION

An embodiment of the present disclosure will be described below with reference to the drawings.

Embodiments of the present disclosure will be described below. However, the present disclosure is not limited thereto.

Figure 1A:
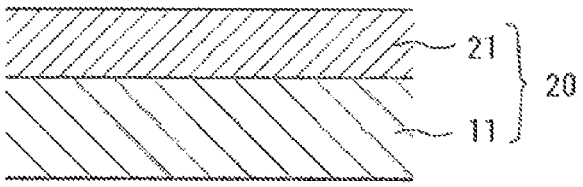
FIG. 1A is a view showing an example of a structure of a single-layer-type electrophotographic photosensitive member according to an embodiment.
Figure 1B:
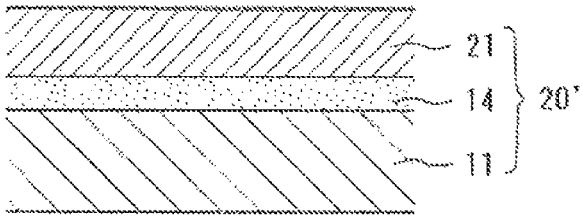
FIG. 1B is a view showing another example of a structure of a single-layer-type electrophotographic photosensitive member according to the embodiment.

A single-layer-type electrophotographic photosensitive member according to an embodiment will be described in more detail. As shown in FIG. 1A, a single-layer-type electrophotographic photosensitive member 20 according to an embodiment includes a substrate 11 and a single-layer photosensitive layer 21 formed on the substrate 11 using a photosensitive layer application liquid containing a specific solvent, the photosensitive layer 21 containing a charge-generating material, a charge transport material, and a binder resin. The structure of the single-layer-type electrophotographic photosensitive member 20 is not particularly limited as long as it includes the substrate 11 and the photosensitive layer 21. Specifically, for example, the photosensitive layer 21 may be directly disposed on the substrate 11, or as shown in FIG. 1B, an electrophotographic photosensitive member 20' may include an intermediate layer 14 between the substrate 11 and the photosensitive layer 21. Furthermore, the photosensitive layer 21 may be exposed as an outermost layer, or a protective layer (not shown) may be disposed on the photosensitive layer 21.

The thickness of the photosensitive layer is not particularly limited as long as the photosensitive layer is allowed to function sufficiently. Specifically, for example, the thickness of the photosensitive layer is preferably 5 to 50 μm, and more preferably 10 to 35 μm.

The charge-generating material (CGM) contains a phthalocyanine pigment and N-type pigments including at least a perylene-based pigment and an azo-based pigment. The phthalocyanine pigment is not particularly limited as long as it can be used as a charge-generating material for an electrophotographic photosensitive member. Specific examples of the phthalocyanine pigment include an X-type metal-free phthalocyanine (x-H2Pc) represented by the formula (1) below and a Y-type oxotitanium phthalocyanine.

(1)

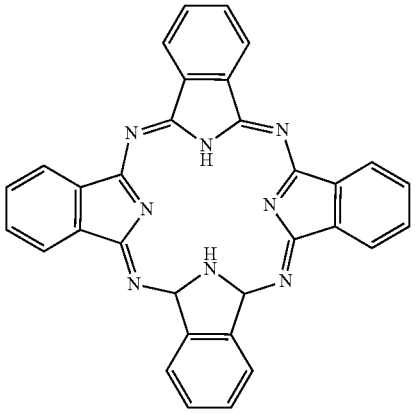

Among these phthalocyanine pigments, a Y-type oxotitanium phthalocyanine (Y-TiOPc) and an oxotitanium phthalocyanine (A) having a maximum peak at a Bragg angle (2θ±0.2°) of 27.2° in a Cu—Kα characteristic X-ray diffraction spectrum and (B) having one peak in a range of 270° C. to 400° C. except for peaks attributed to vaporization of adsorption water in a differential scanning calorimetry have high sensitivity, and therefore are preferred.

Pigments used as a charge-generating material are broadly classified into N-type and P-type pigments. In an N-type pigment, the major charge carriers are electrons, and in a P-type pigment, the major charge carriers are holes. In the present invention, as the charge-generating material, a phthalocyanine pigment, which is a P-type pigment, and a perylene-based pigment and an azo-based pigment, which are N-type pigments, are combined for use.

The charge-generating material may contain charge-generating materials other than the phthalocyanine pigment, the perylene-based pigment, and the azo-based pigment within a range that does not impair the present disclosure. Examples of the charge-generating materials other than the phthalocyanine pigment, the perylene-based pigment, and the azo-based pigment include dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials, such as selenium, selenium-tellurium, selenium-arsenic, cadmium sulfide, and amorphous silicon, pyrylium salts, anthanthrone-based pigments, triphenylmethane-based pigments, threne-based pigments, toluidine-based pigments, pyrazoline-based pigments, and quinacridone-based pigments.

The perylene-based pigment is not particularly limited as long as it can be used as a charge-generating material for an electrophotographic photosensitive member and is composed of a compound having a skeleton represented by the formula (I) below. The aromatic rings in the formula (I) below may be substituted with one or more halogen atoms. Examples of halogen atoms include chlorine, bromine, iodine, and fluorine.

(I)

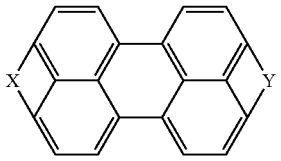

(In the formula (I), X and Y are each independently a divalent organic group.)

The structure of the perylene-based pigment is not particularly limited as long as the above conditions are satisfied. Preferably, the perylene-based pigment does not have a phthalocyanine skeleton in its structure.

A perylene-based pigment represented by the formula (II) or (III) below is preferably used.

(II)

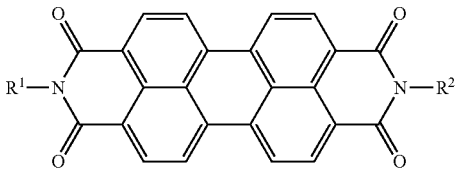

(In the formula, $R^1$ and $R^2$ are each independently a hydrogen atom or a monovalent organic group.)

(III)

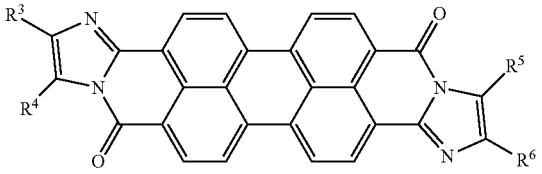

(In the formula, $R^3$ to $R^6$ are each independently a hydrogen atom or a monovalent organic group. $R^3$ and $R^4$, or $R^5$ and $R^6$ may bind to each other to form a ring.)

In the formula (II), preferable examples of $R^1$ and $R^2$ include a hydrogen atom, an aliphatic hydrocarbon group, an aralkyl group, an aryl group, and a heterocyclic group. Examples of the heteroatom which may be contained in the heterocyclic group include a nitrogen atom, an oxygen atom, and a sulfur atom.

When $R^1$ and $R^2$ are each an aliphatic hydrocarbon group, the aliphatic hydrocarbon group may be straight-chain, branched, cyclic, or a combination of these. Furthermore, the aliphatic hydrocarbon group may be saturated or unsaturated, but preferably saturated.

When the aliphatic hydrocarbon group is straight-chain or branched, the number of carbon atoms of the aliphatic hydrocarbon group is preferably 1 to 20, more preferably 1 to 10, particularly preferably 1 to 6, and most preferably 1 to 4. Preferable examples of the straight-chain or branched aliphatic hydrocarbon group include a methyl group, an ethyl group, an n-propyl group, an isopropyl group, an n-butyl group, an isobutyl group, a sec-butyl group, a tert-butyl group, an n-pentyl group, an n-hexyl group, an n-heptyl group, an n-octyl group, an n-nonyl group, and an n-decyl group.

When the aliphatic hydrocarbon group is cyclic, the number of carbons thereof is preferably 3 to 10, and more preferably 5 to 8. Preferable examples of the cyclic aliphatic hydrocarbon group include a cyclohexyl group and a cyclopentyl group.

When $R^1$ and $R^2$ are each an aralkyl group, the number of carbon atoms of the aralkyl group is preferably 7 to 12. Preferable examples of the aralkyl group include a benzyl group, a phenethyl group, an α-naphthylmethyl group, and a β-naphthylmethyl group.

When $R^1$ and $R^2$ are each an aryl group, the aryl group is a monocyclic or fused-ring hydrocarbon group including at least one benzene ring, and a bond of the aryl group binds to the benzene ring. When the aryl group is a fused-ring hydrocarbon group, the number of rings constituting the fused ring is preferably 3 or less. In the aryl group, the ring condensed with the benzene ring with the bond may be an aromatic ring or aliphatic ring. In the aryl group, the ring condensed with the benzene ring with the bond is preferably a four- to eight-membered ring, and more preferably a five- or six-membered ring.

Preferable examples of the aryl group include a phenyl group, a naphthyl group, an anthranil group, a phenanthryl group, an indenyl group, a 1,2,3,4-tetrahydronaphthyl group, a fluorenyl group, and an acenaphthylenyl group.

When $R^1$ and $R^2$ are each a heterocyclic group, the heterocycle may be monocyclic or a fused ring. Furthermore, the heterocyclic group may be an aliphatic group or aromatic group. When the heterocyclic group is a fused ring, the number of rings constituting the fused ring is preferably 3 or less. In the heterocyclic group, the rings constituting the fused ring are preferably four- to eight-membered rings, and more preferably five- or six-membered rings.

Preferable examples of the heterocycle contained in the heterocyclic group include pyrrolidine, tetrahydrofuran, piperidine, piperazine, morpholine, thiomorpholine, thiophene, furan, pyrrole, imidazole, pyrazole, isothiazole, isooxazole, pyridine, pyrazine, pyrimidine, pyridazine, triazole, tetrazole, indole, 1H-indazole, purine, 4H-quinolizine, isoquinoline, quinoline, phthalazine, naphthyridine, quinoxaline, quinazoline, cinnoline, pteridine, benzofuran, benzoxazole, benzothiazole, benzimidazole, benzimidazolone, and phthalimide.

When $R^1$ and $R^2$ are each an aralkyl group, an aryl group, or a heterocyclic group, the ring contained in these groups may have a substituent. Examples of the substituent include an alkyl group having 1 to 6 carbon atoms, an alkoxy group having 1 to 6 carbon atoms, a phenyl group, a halogen atom, a hydroxyl group, a cyano group, and a nitro group.

In the formula (III), preferable examples of $R^3$ to $R^6$ include a hydrogen atom, an aliphatic hydrocarbon group, an aralkyl group, an aryl group, and a heterocyclic group. Examples of the heteroatom which may be contained in the heterocyclic group include a nitrogen atom, an oxygen atom, and a sulfur atom.

When $R^3$ to $R^6$ are each an aliphatic hydrocarbon group, an aralkyl group, an aryl group, or a heterocyclic group, the same groups as those described for $R^1$ and $R^2$ are preferable. When $R^3$ to $R^6$ are each an aralkyl group, an aryl group, or a heterocyclic group, the ring contained in these groups may have a substituent. Examples of the substituent include an alkyl group having 1 to 6 carbon atoms, an alkoxy group having 1 to 6 carbon atoms, a phenyl group, a halogen atom, a hydroxyl group, a cyano group, and a nitro group.

$R^3$ and $R^4$, or $R^5$ and $R^6$ may bind to each other to form a ring. The ring formed by binding of $R^3$ and $R^4$, or $R^5$ and $R^6$ may be an aromatic ring, an aliphatic ring, a hydrocarbon ring, or a heterocycle. Preferable examples of the ring formed by binding of $R^3$ and $R^4$, or $R^5$ and $R^6$ include a benzene ring, a naphthalene ring, a pyridine ring, and a tetrahydronaphthalene ring.

Preferable specific examples of the perylene-based pigment are shown below.

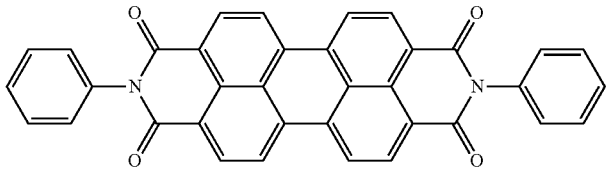

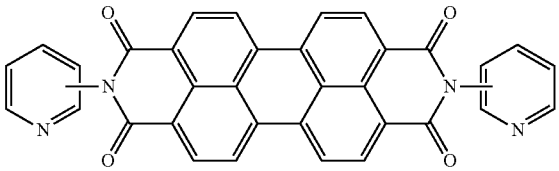

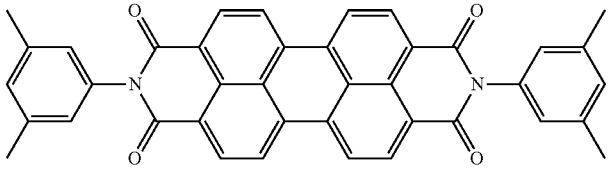

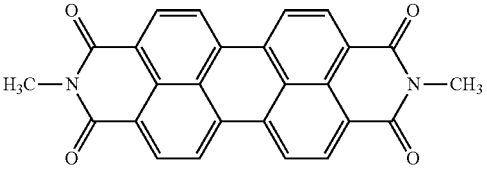

-continued
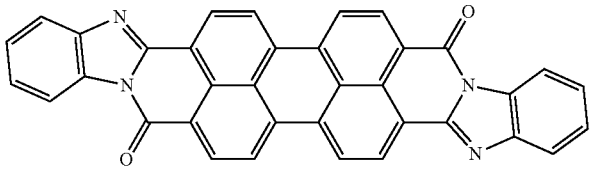
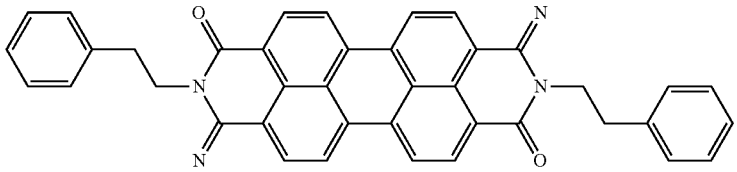
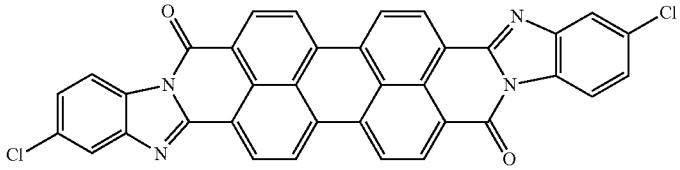
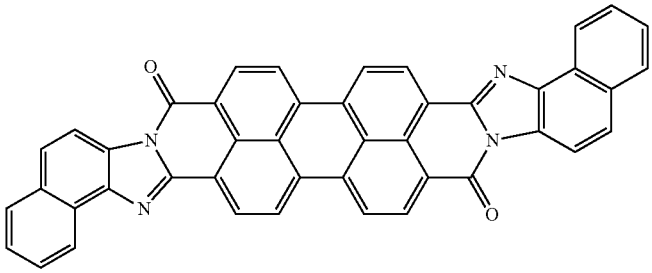
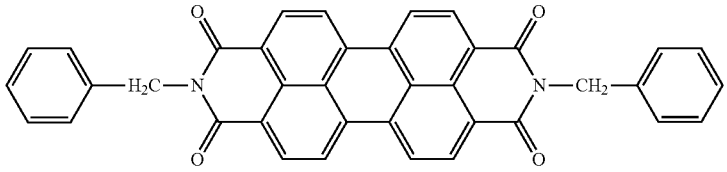
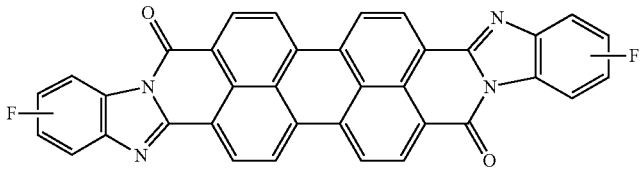
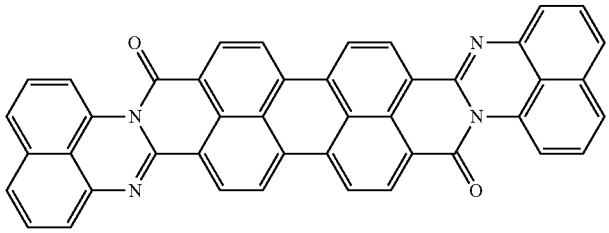
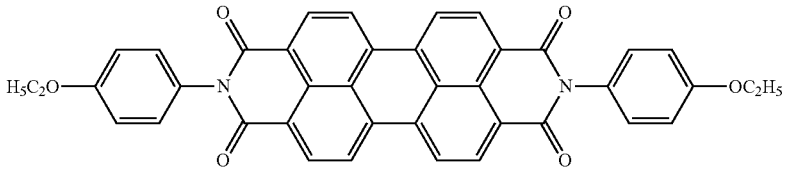
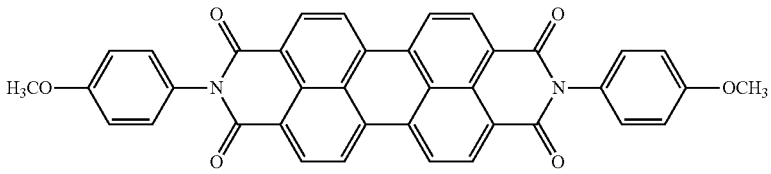

-continued

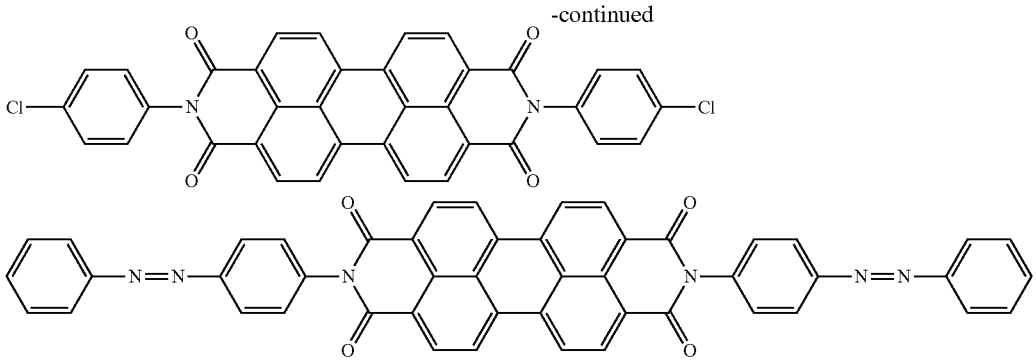

The azo-based pigment is not particularly limited as long as it can be used as a charge-generating material for an electrophotographic photosensitive member and has an azo group (—N═N—) in its structure. Any of monoazo pigments and polyazo pigments, such as bis-azo pigments, tris-azo pigments, and tetrakis-azo pigments, can be used as the azo-based pigment. Furthermore, the azo-based pigment may be a tautomer of a compound having an azo group.

The structure of the azo-based pigment is not particularly limited as long as the above conditions are satisfied. Preferably, the azo-based pigment does not have a phthalocyanine skeleton in its structure.

Preferable examples of the azo-based pigment include PY83, PY93, PY128, PO13, PY95, PY94, PY166, PR144, PO2, PR32, PR30, PY14, PY17, PO34, and PY77.

The N-type pigments used together with the phthalocyanine pigment may include N-type pigments other than the perylene-based pigment and the azo-based pigment. Examples of the N-type pigments other than the perylene-based pigment and the azo-based pigment include known organic pigments, such as polycyclic quinone-based pigments, squarylium-based pigments, and pyranthrone-based pigments.

The hole transport material (HTM) is not particularly limited as long as it can be used as a hole transport material contained in a photosensitive layer of a single-layer-type electrophotographic photosensitive member. Specific examples of the hole transport material include nitrogen-containing cyclic compounds and condensed polycyclic compounds, such as benzidine derivatives, oxadiazole compounds (e.g., 2,5-di(4-methylaminophenyl)-1,3,4-oxadiazole), styryl compounds (e.g., 9-(4-diethylaminostyryl)anthracene), carbazole compounds (e.g., polyvinylcarbazole), organic polysilane compounds, pyrazoline compounds (e.g., 1-phenyl-3-(p-dimethylaminophenyl) pyrazoline), hydrazone compounds, triphenylamine compounds, indole compounds, oxazole compounds, isoxazole compounds, thiazole compounds, and triazole compounds. Among these hole transport materials, triphenylamine compounds having one or a plurality of triphenylamine skeletons in their molecules are preferable. These hole transport materials may be used alone or in combination of two or more.

The electron transport material (ETM) is not particularly limited as long as it can be used as an electron transport material contained in a photosensitive member of a single-layer-type electrophotographic photosensitive member. Specific examples thereof include quinone derivatives, such as naphthoquinone derivatives, diphenoquinone derivatives, anthraquinone derivatives, azoquinone derivatives, nitroanthraquinone derivatives, and dinitroanthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, tetracyanoethylene, 2,4,8-trinitrothioxanthone, dinitrobenzene, dinitroanthracene, dinitroacridine, succinic anhydride, maleic anhydride, and dibromomaleic anhydride. The electron transport materials may be used alone or in combination of two or more.

(Binder Resin)

The binder resin is not particularly limited as long as it can be used as a binder resin contained in a photosensitive layer of a single-layer-type electrophotographic photosensitive member. Specific examples of the resin that is preferably used as the binder resin include thermoplastic resins, such as polycarbonate resins, styrene resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyamide resins, polyurethane resins, polyarylate resins, polysulfone resins, diallyl phthalate resins, ketone resins, polyvinyl butyral resins, and polyether resins; thermosetting resins, such as silicone resins, epoxy resins, phenolic resins, urea resins, melamine resins, and other crosslinkable thermosetting resins; and photocurable resins, such as epoxy acrylate resins and urethane-acrylate copolymer resins. These resins may be used alone or in combination of two or more.

Among these resins, polycarbonate resins, such as bisphenol Z-type polycarbonate resins, bisphenol ZC-type polycarbonate resins, bisphenol C-type polycarbonate resins, and bisphenol A-type polycarbonate resins, are more preferably used from the standpoint that it is possible to obtain a photosensitive layer having a good balance among workability, mechanical properties, optical properties, and abrasion resistance.

(Additives)

In addition to the charge-generating material, the hole transport material, the electron transport material, and the binder resin, various additives may be incorporated into the photosensitive layer of the single-layer-type electrophotographic photosensitive within the range that does not adversely affect the electrophotographic characteristics. Examples of additives that can be incorporated into the photosensitive layer include anti-degradation agents, such as antioxidants, radical scavengers, singlet quenchers, and ultraviolet absorbers; softeners; plasticizers; polycyclic aromatic compounds; surface modifiers; extenders; thickening agents; dispersion stabilizers; waxes; oils; acceptors; donors; surfactants; and leveling agents.

The method for producing a single-layer-type electrophotographic photosensitive member is not particularly limited within the range that does not impair the present disclosure. A preferable example of the method for producing a single-layer-type electrophotographic photosensitive member is a method in which a photosensitive layer application liquid is applied onto a substrate to form a photosensitive layer. Specifically, by applying an application liquid, in which a polycyclic aromatic compound, a charge-generating material, a charge transport material, a binder resin, and, as necessary, various additives are dissolved or dispersed in a solvent, onto a substrate, followed by drying, a single-layer-type electrophotographic photosensitive member can be produced. The application method is not particularly limited. For example, a method using a spin coater, an applicator, a spray coater, a bar coater, a dip coater, a doctor blade, or the like may be used. Among these application methods, a dipping method using a dip coater is preferable from the standpoint that continuous production is possible and economic efficiency is high. As the method for drying the coating film formed on the substrate, for example, a method in which hot-air drying is performed at 80° C. to 150° C. for 15 to 120 minutes may be used.

In the single-layer-type electrophotographic photosensitive member according to an embodiment, the content of each of the charge-generating material (CGM), the hole transport material (HTM), the electron transport material (ETM), and the binder resin is appropriately selected and is not particularly limited. Specifically, for example, the content of the charge-generating material is preferably 0.3 to 30 parts by mass, more preferably 0.5 to 10 parts by mass, relative to 100 parts by mass of the binder resin. The content of the electron transport material is preferably 20 to 90 parts by mass, more preferably 40 to 60 parts by mass, relative to 100 parts by mass of the binder resin. The content of the hole transport material is preferably 30 to 120 parts by mass, more preferably 50 to 100 parts by mass, relative to 100 parts by mass of the binder resin. Furthermore, the total amount of the hole transport material and the electron transport material, i.e., the content of the charge transport material, is preferably 60 to 150 parts by mass, more preferably 80 to 120 parts by mass, relative to 100 parts by mass of the binder resin.

The content ratio between the phthalocyanine pigment and the N-type pigments is not particularly limited and can be set within a broad range. From the standpoint that the N-type pigments enhance the dispersibility of the phthalocyanine pigment to suppress occurrence of the memory phenomenon, the total amount of the N-type pigments to be used is preferably 0.03 to 10 parts by mass, more preferably 0.3 to 3 parts by mass, relative to 1 part by mass of the phthalocyanine pigment. The total content of the perylene-based pigment and the azo-based pigment in the N-type pigments is not particularly limited within the range that does not impair the present disclosure. The ratio of the total content of the perylene-based pigment and the azo-based pigment to the mass of the N-type pigments is preferably 80% by mass or more, more preferably 90% by mass or more, particularly preferably 95% by mass or more, and most preferably 100% by mass.

The solvent contained in the photosensitive layer application liquid is not particularly limited as long as it can dissolve or disperse the components constituting the photosensitive layer. Specific examples thereof include alcohols, such as methanol, ethanol, isopropanol, and butanol; aliphatic hydrocarbons, such as n-hexane, octane, and cyclohexane; aromatic hydrocarbons, such as benzene, toluene, and xylene; halogenated hydrocarbons, such as dichloromethane, dichloroethane, carbon tetrachloride, and chlorobenzene; ethers, such as dimethyl ether, diethyl ether, tetrahydrofuran, ethylene glycol dimethyl ether, and diethylene glycol dimethyl ether; ketones, such as acetone, methyl ethyl ketone, methyl isobutyl ketone, and cyclohexanone; esters, such as ethyl acetate and methyl acetate; and aprotic polar organic solvents, such as dimethylformaldehyde, dimethylformamide, and dimethylsulfoxide. These solvents may be used alone or in combination of two or more.

An image forming apparatus according to another embodiment of the present invention includes an image-supporting member, a charging device for charging a surface of the image-supporting member, an exposing device for exposing the charged surface of the image-supporting member and forming an electrostatic latent image on the surface of the image-supporting member, a developing device for developing the electrostatic latent image to form a toner image, and a transferring device for transferring the toner image from the image-supporting member to a transfer-receiving medium. The image-supporting member is the single-layer-type electrophotographic photosensitive member according to the first embodiment, and the charging device positively charges the image-supporting member. Since the image forming apparatus according to this embodiment has the structure described above, even in the case where a charge-removing device is not included, generation of exposure memory can be suppressed, and a good image can be obtained.

Although the image forming apparatus according to this embodiment can be applied to both a monochrome image forming apparatus and a color image forming apparatus, a tandem color image forming apparatus which uses a plurality of color toners is preferable. A specific example is a tandem color image forming apparatus which uses a plurality of color toners as described below. Here, description will be made on a tandem color image forming apparatus.

An image forming apparatus provided with single-layer-type electrophotographic photosensitive members according to the first embodiment includes a plurality of image-supporting members arranged in order in a predetermined direction so that different color toner images are formed on the surfaces of the image-supporting members, and a plurality of developing devices arranged so as to face their corresponding image-supporting members, the developing devices each being provided with a development roller which supports a toner on the surface thereof, transports the toner, and supplies the transported toner to the surface of the corresponding image-supporting member. As the image-supporting members, the single-layer-type electrophotographic photosensitive members are used.

Figure 2:
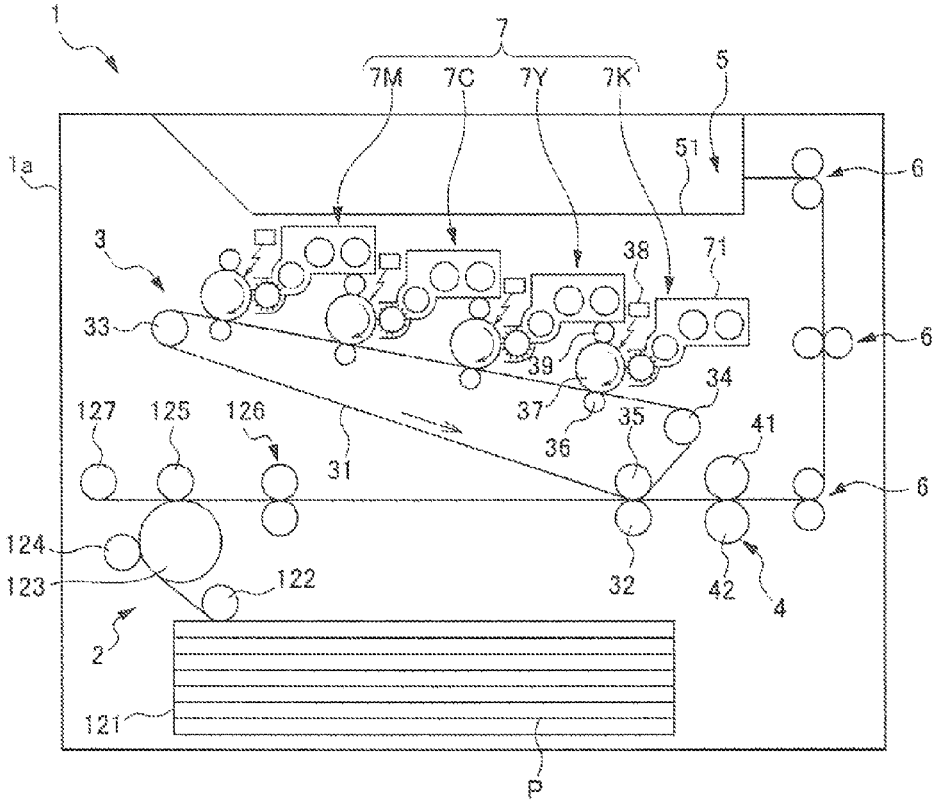
FIG. 2 is a schematic view showing a structure of an image forming apparatus including single-layer-type electrophotographic photosensitive members according to an embodiment.

FIG. 2 is a schematic view showing a structure of an image forming apparatus including single-layer-type electrophotographic photosensitive members according to the first embodiment discussed above. As an example of the image forming apparatus, a color printer 1 will be described.

As shown in FIG. 2, the color printer 1 has a box-shaped apparatus main body 1*a* and includes, inside the apparatus main body 1*a*, a paper feeding section 2 which feeds a sheet P, an image forming section 3 which transfers toner images based on image data and the like to the sheet P while transporting the sheet P fed from the paper feeding section 2, and a fixing section 4 which fixes unfixed toner images, which have been transferred by the image forming section 3 to the sheet P, on the sheet P. Furthermore, a paper ejection section 5 is provided on the upper surface of the apparatus main body 1*a*, into which the sheet P subjected to fixing treatment in the fixing section 4 is ejected.

The paper feeding section 2 includes a paper feed cassette 121, a pick-up roller 122, paper feed rollers 123, 124, and 125, and a registration roller 126. The paper feed cassette 121 is detachably attached to the apparatus main body 1*a* and stores sheets P of various sizes. The pick-up roller 122 is located on the upper left position of the paper feed cassette 121 as shown in FIG. 2, and picks up the sheets P stored in the paper feed cassette 121 one at a time. The paper feed rollers 123, 124, and 125 send the sheet P picked up by the pick-up roller 122 to a sheet transport path. The registration roller 126 temporarily holds the sheet P sent to the sheet transport path by the paper feed rollers 123, 124, and 125, and then feeds the sheet P to the image forming section 3 at a predetermined timing.

The paper feeding section 2 also includes a manual feed tray (not shown) to be mounted on the left side surface of the apparatus main body 1*a* shown in FIG. 2 and a pick-up roller 127. The pick-up roller 127 picks up a sheet P placed in the manual feed tray. The sheet P picked up by the pick-up roller 127 is sent to the sheet transport path by the paper feed rollers 123 and 125, and is fed to the image forming section 3 by the registration roller 126 at a predetermined timing.

The image forming section 3 includes an image forming unit 7, an intermediate transfer belt 31 onto the surface (contact surface) of which a toner image based on image data transmitted from a computer or the like is primary-transferred by the image forming unit 7, and a secondary transfer roller 32 for secondary-transferring the toner image on the intermediate transfer belt 31 onto a sheet P fed from the paper feed cassette 121.

The image forming unit 7 includes a unit 7K for black, a unit 7Y for yellow, a unit 7C for cyan, and a unit 7M for magenta which are arranged in that order from the upstream side (the right side in FIG. 2) toward the downstream side. A single-layer-type electrophotographic photosensitive member 37 (hereinafter, may be referred to as the photosensitive member 37) serving as an image-supporting member is positioned in the center of each of the units 7K, 7Y, 7C, and 7M so as to be rotatable in the direction indicated by the arrow (clockwise). A charging device 39, an exposing device 38, a developing device 71, a cleaning device (not shown), a static eliminator as a charge-removing device (not shown), and the like are located in that order from the upstream side in the rotation direction around each photosensitive member 37. In the present disclosure, even in the case where a charge-removing step with a static eliminator is not included, an image can be formed satisfactorily, and therefore, space saving is possible. As the photosensitive members 37, single-layer-type electrophotographic photosensitive members are preferably used.

The charging device 39 uniformly positively charges the peripheral surface of the electrophotographic photosensitive member 37 rotated in the direction indicated by the arrow. The charging device 39 is not particularly limited as long as it can uniformly charge the peripheral surface of the electrophotographic photosensitive member 37 and may be of non-contact type or contact type. Examples of the charging device include a corona charging device, a charging roller, and a charging brush. A charging device of contact type, such as a charging roller or charging brush, is preferable. By using the contact-type charging device 39, it is possible to suppress emission of active gas, such as ozone or nitrogen oxides, generated from the charging device 39, and degradation of the photosensitive layer of the electrophotographic photosensitive member due to active gas can be prevented. It is also possible to make a design considering the office environment or the like.

In a charging device 39 provided with a charging roller of the contact type, the charging roller charges the peripheral surface (surface) of the photosensitive member 37 while being in contact with the photosensitive member 37. As such a charging roller, for example, a charging roller which rotates following the rotation of the photosensitive member 37 while being in contact with the photosensitive member 37 may be used. Furthermore, as the charging roller, for example, a roller at least a surface portion of which is made of a resin may be used. More specifically, an example of the charging roller includes a metal core rotatably supported around an axis, a resin layer disposed on the metal core, and a voltage-applying portion which applies a voltage to the metal core. In a charging device 39 provided with such a charging roller, by applying a voltage to the metal core by the voltage-applying portion, it is possible to charge the surface of the photosensitive member 37 which is in contact with the metal core with the resin layer therebetween.

The voltage to be applied to the charging roller by the voltage-applying portion is preferably a DC voltage only. The DC voltage to be applied to the electrophotographic photosensitive member by the charging roller is preferably 1,000 to 2,000 V, more preferably 1,200 to 1,800 V, and particularly preferably 1,400 to 1,600 V. In the case where a DC voltage only is applied to the charging roller, the abrasion loss of the photosensitive layer tends to decrease compared with the case where an AC voltage or a superimposed voltage obtained by superimposing an AC voltage on a DC voltage is applied.

The resin constituting the resin layer of the charging roller is not particularly limited as long as the peripheral surface of the photosensitive member 37 can be satisfactorily charged. Specific examples of the resin used for the resin layer include a silicone resin, a urethane resin, and a silicone-modified resin. Furthermore, an inorganic filler may be incorporated into the resin layer.

The exposing device 38 is a laser scanning unit and irradiates, with a laser beam based on image data inputted from a personal computer (PC) which is a higher-level device, the peripheral surface of the photosensitive member 37 uniformly charged by the charging device 39 to form an electrostatic latent image on the photosensitive member 37.

The developing device 71 forms a toner image based on the image data by supplying a toner to the peripheral surface of the photosensitive member 37 on which the electrostatic latent image has been formed. The toner image is primary-transferred onto the intermediate transfer belt 31.

The cleaning device cleans the residual toner on the peripheral surface of the photosensitive member 37 after the toner image has been primary-transferred onto the intermediate transfer belt 31. The peripheral surface of the photosensitive member 37 which has been subjected to cleaning treatment by the cleaning device moves toward the charging device 39 for new charging treatment and is subjected to charging treatment.

The intermediate transfer belt 31 is an endless belt-shaped rotating member, and travels around a plurality of rollers, such as a driving roller 33, a driven roller 34, a back-up roller 35, and a primary transfer roller 36, such that the surface (contact surface) thereof comes into contact with the peripheral surface of each photosensitive member 37. The intermediate transfer belt 31 is configured to be rotated by a plurality of rollers while being pressed against each photosensitive member 37 by the primary transfer roller 36 arranged facing the photosensitive member 37. The driving roller 33 is rotated by a driving source, such as a stepping motor, and provides a driving force for endless rotation of the intermediate transfer belt 31. The driven roller 34, the back-up roller 35, and the primary transfer rollers 36 are rotatably provided, and rotate following the endless rotation of the intermediate transfer belt 31 caused by the driving roller 33. The rollers 34, 35, and 36 are driven to rotate via the intermediate transfer belt 31 in response to the rotation of the driving roller 33, and support the intermediate transfer belt 31.

The primary transfer roller 36 applies a primary transfer bias (having a reverse polarity to the charge polarity of the toner) to the intermediate transfer belt 31. Thereby, the toner images formed on the photosensitive members 37 are transferred (primary-transferred) onto the intermediate transfer belt 31 one after another in a superimposed state, the intermediate transfer belt 31 being driven to go around in the direction indicated by the arrow (counterclockwise) by the drive of the driving roller 33 between the photosensitive members 37 and their corresponding primary transfer rollers 36.

The secondary transfer roller 32 applies a secondary transfer bias having a reverse polarity to the polarity of the toner image to the sheet P. Thereby, the toner image primary-transferred onto the intermediate transfer belt 31 is transferred to the sheet P between the secondary transfer roller 32 and the back-up roller 35. As a result, a color transfer image (unfixed toner image) is formed on the sheet P.

The fixing section 4 fixes the transfer image transferred to the sheet P in the image forming section 3, and includes a heating roller 41 which is heated with an electrically heating element, and a pressure roller 42 which faces the heating roller 41 and the peripheral surface of which is pressed against the peripheral surface of the heating roller 41.

The transfer image transferred to the sheet P by the secondary transfer roller 32 in the image forming section 3 is fixed to the sheet P through fixing treatment by heating when the sheet P passes between the heating roller 41 and the pressure roller 42.

The sheet P subjected to the fixing treatment is ejected to the paper ejection section 5. In the color printer 1 according to this embodiment, conveyor rollers 6 are arranged in appropriate places between the fixing section 4 and the paper ejection section 5.

The paper ejection section 5 is formed by recessing the top of the apparatus main body 1*a* of the color printer 1, and a paper output tray 51 for receiving the ejected sheet P is formed at the bottom of the recessed portion.

The color printer 1 forms an image on the sheet P by the image-forming operation described above. In the tandem image forming apparatus described above, since single-layer-type electrophotographic photosensitive members according to the first discussed embodiment are provided as image-supporting members, generation of exposure memory can be suppressed, and a good image can be formed.

EXAMPLES

The present invention will be described in more detail below on the basis of examples. It is to be understood that the present invention is not limited to the examples.

[Production of Photosensitive Member]

In each example, 3 parts by mass of the charge-generating material, 1 part by mass of the perylene-based pigment, and 1 part by mass of the azo-based pigment, shown in Table 1 or 2, were added to 100 parts of tetrahydrofuran, and dispersing was carried out for one hour in a ball mill. Then, 60 parts by mass of the hole transport material and 50 parts by mass of the electron transport material, shown in Table 1 or 2, 0.01 parts of a leveling agent (KF96 manufactured by Shin-Etsu Chemical Co., Ltd.), 100 parts by mass of a bisphenol Z-type polycarbonate resin with a viscosity average molecular weight of 30,000, and 800 parts by mass of tetrahydrofuran were added into the ball mill, and mixing and dispersing were carried out for six hours. Thereby, a photosensitive layer application liquid was prepared. Note that, regarding the perylene-based pigment and the azo-based pigment in each of Example 35, Example 36, Comparative Example 12, and Comparative Example 13, the amounts, parts by mass, shown in the table were added instead of the amounts described above.

The resulting application liquid was applied by a dip-coating method onto an electrically conductive substrate, followed by treatment at 100° C. for 40 minutes to remove tetrahydrofuran from the coating film. Thereby, a single-layer electrophotographic photosensitive member including a photosensitive layer with a thickness of 25 μm was obtained.

Symbols and chemical structures of the materials shown in Tables 1 and 2 are described below.

<Charge-Generating Material (CGM)>

CG1: X-type metal-free phthalocyanine

CG2: Oxotitanium phthalocyanine (A) having a maximum peak at a Bragg angle (2θ±0.2°) of 27.2° and no peak at 26.2° in a Cu—Kα characteristic X-ray diffraction spectrum and (B) having one peak in a range of 50° C. to 270° C. except for peaks attributed to vaporization of adsorption water in a differential scanning calorimetry CG3: Oxotitanium phthalocyanine (A) having a maximum peak at a Bragg angle (2θ±0.2°) of 27.2° and no peak at 26.2° in a Cu—Kα characteristic X-ray diffraction spectrum and (C) having no peak in a range of 50° C. to 400° C. except for peaks attributed to vaporization of adsorption water in a differential scanning calorimetry CG4: Oxotitanium phthalocyanine (A) having a maximum peak at a Bragg angle (2θ±0.2°) of 27.2° and no peak at 26.2° in a Cu—Kα characteristic X-ray diffraction spectrum and (D) having one peak in a range of 270° C. to 400° C. except for peaks attributed to vaporization of adsorption water in a differential scanning calorimetry CG5: Oxotitanium phthalocyanine having major diffraction peaks at least at Bragg angles (2θ±0.2°) of 7.6° and 28.6° in a Cu—Kα characteristic X-ray diffraction spectrum Furthermore, the hole transport materials (HTMs), electron transport materials (ETMs), perylene-based pigments, and azo-based pigments shown below were used.

<Azo-Based Pigment>

Azo 1:

[Chemical Formula 6]

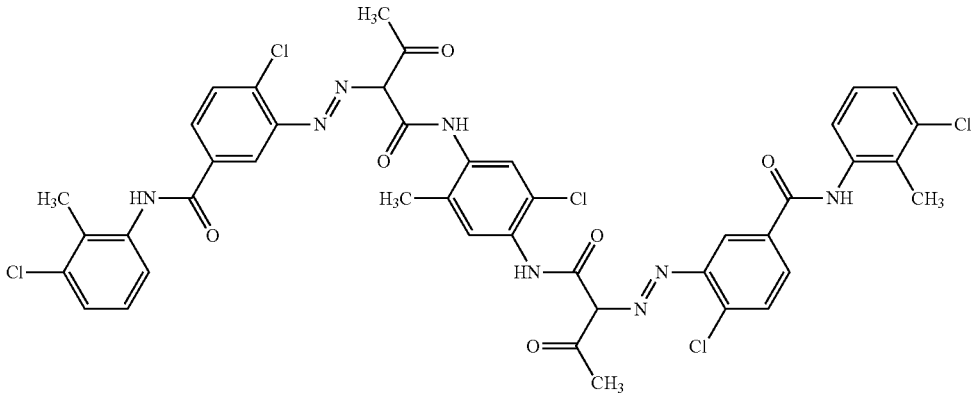

-continued
Azo 2:
[Chemical Formula 7]
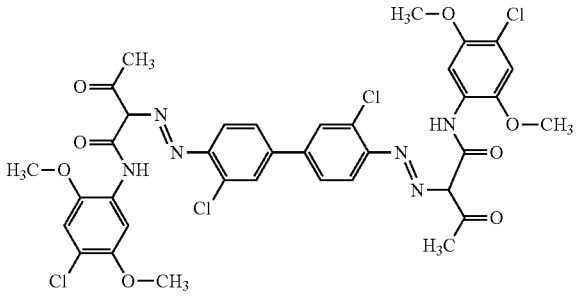
Azo 3:
[Chemical Formula 8]
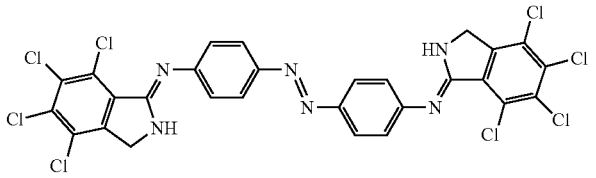
Azo 4:
[Chemical Formula 9]
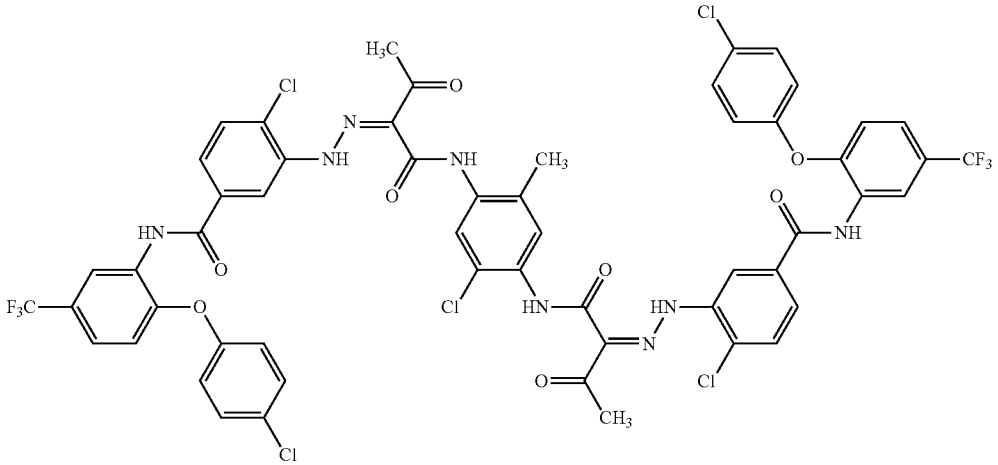
Azo 5:
[Chemical Formula 10]
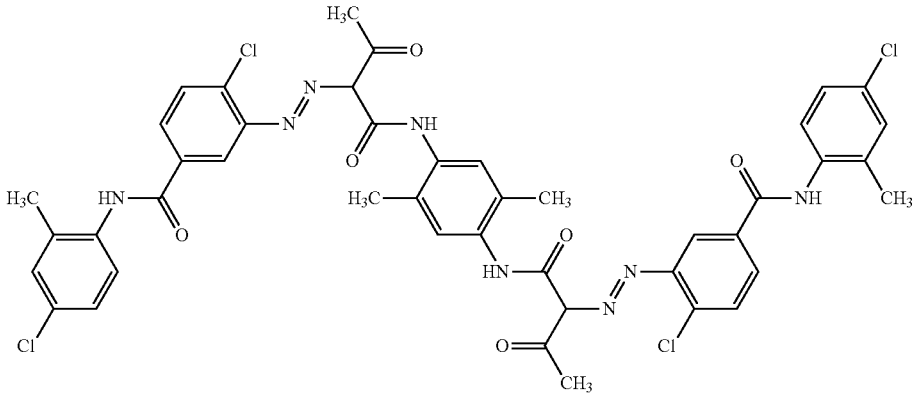
Azo 6:
[Chemical Formula 11]
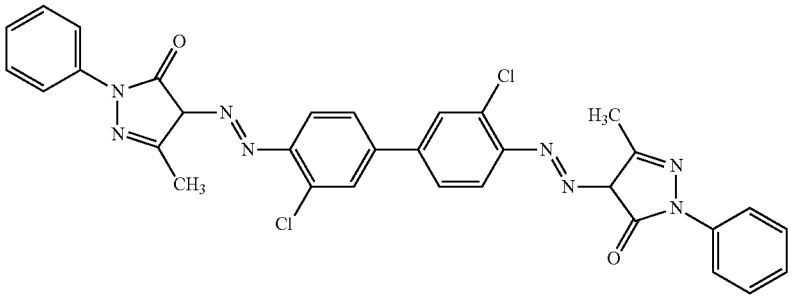

Azo 7:
[Chemical Formula 12]
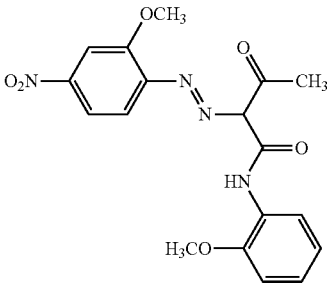
-continued
Azo 8:
[Chemical Formula 13]
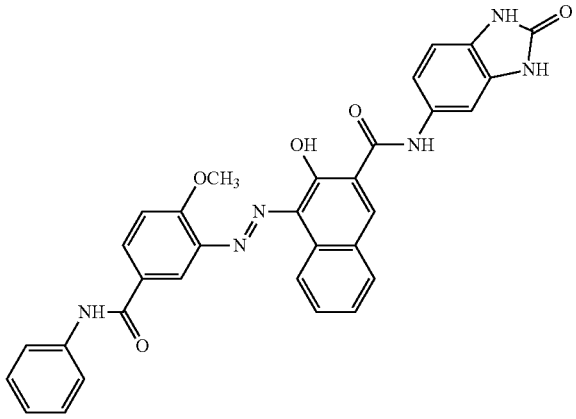
<Perylene-Based Pigment>
Perylene 1:
[Chemical Formula 14]
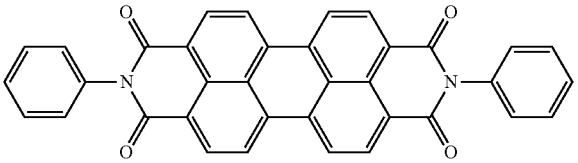
Perylene 2:
[Chemical Formula 15]
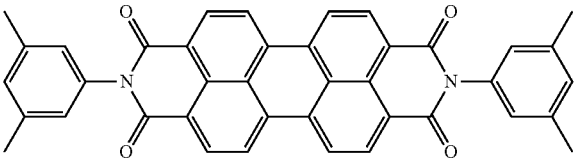
Perylene 3:
[Chemical Formula 16]
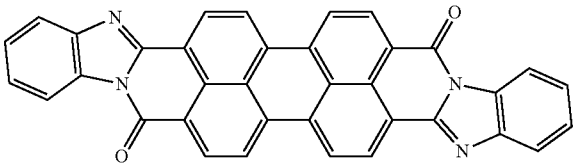
Perylene 4:
[Chemical Formula 17]
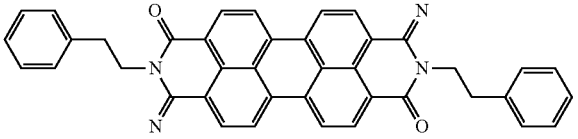
-continued
Perylene 5:
[Chemical Formula 18]
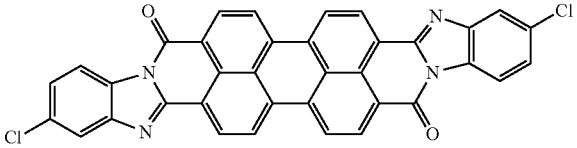
Perylene 6:
[Chemical Formula 19]
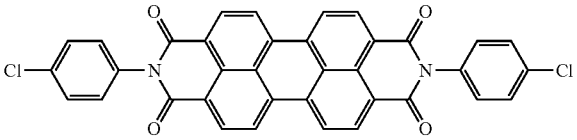
Perylene 7:
[Chemical Formula 20]
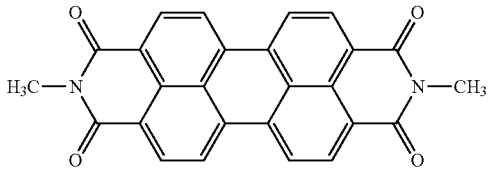
Perylene 8:
[Chemical Formula 21]
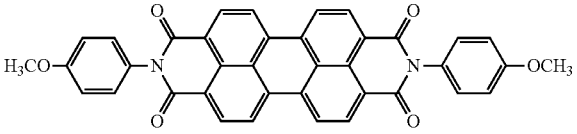

<Hole Transport Material (HTM)>
HT1:
[Chemical Formula 22]
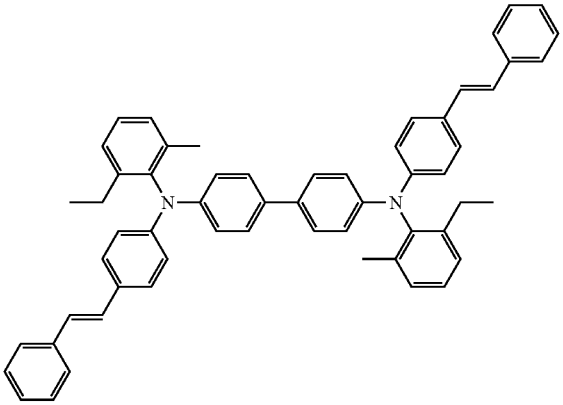
HT2:
[Chemical Formula 23]
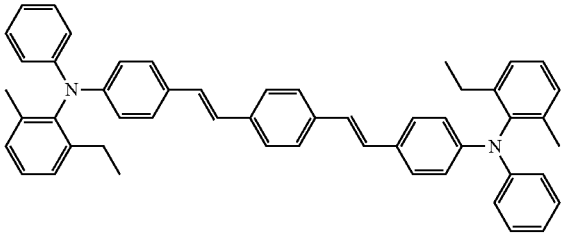
HT3:
[Chemical Formula 24]
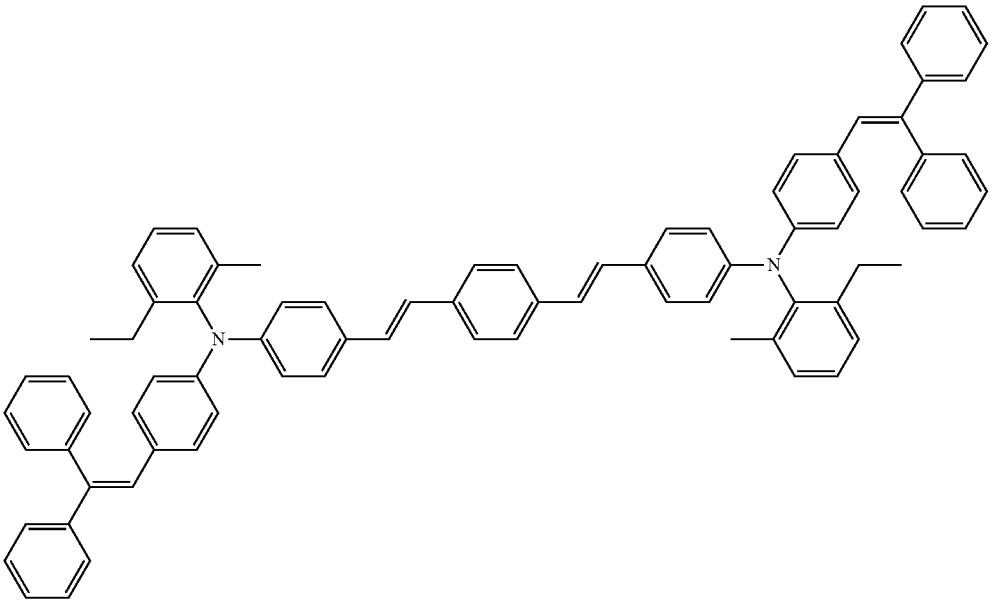
HT4:
[Chemical Formula 25]
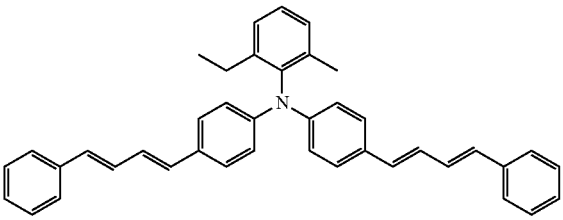
HT5:
[Chemical Formula 26]
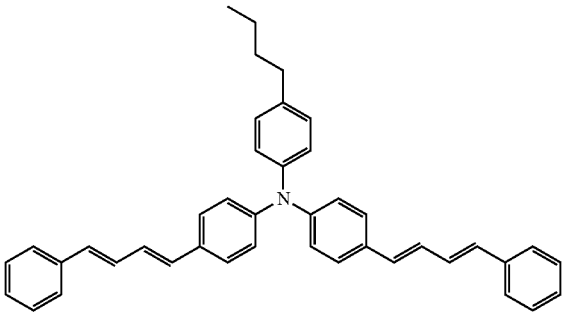

-continued
HT6:
[Chemical Formula 27]
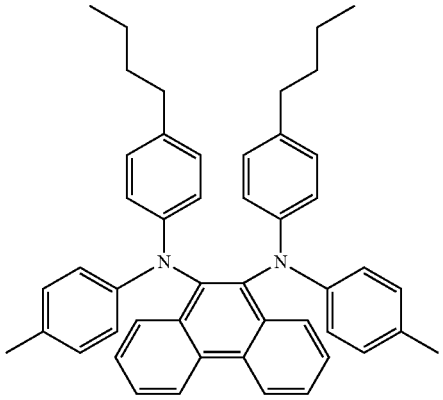
HT7:
[Chemical Formula 28]
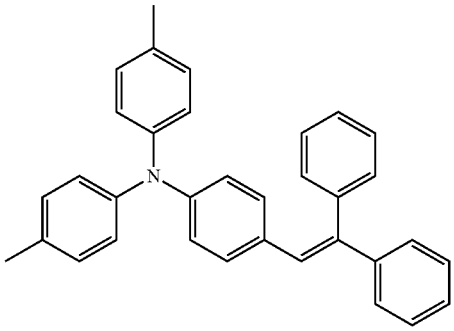
HT8:
[Chemical Formula 29]
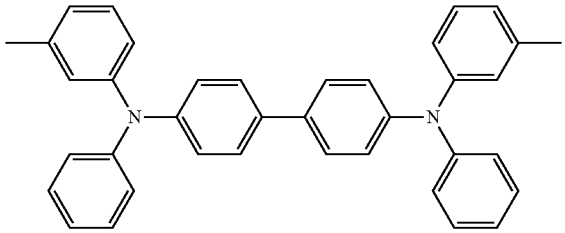
<Electron Transport Material (ETM)>
ET1:
[Chemical Formula 30]
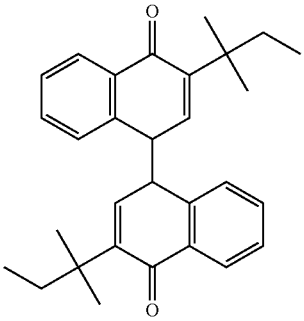
ET2:
[Chemical Formula 31]
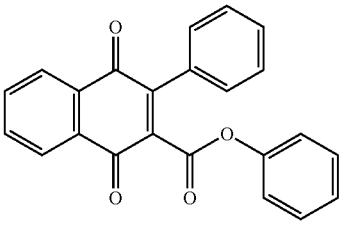
-continued
ET3:
[Chemical Formula 32]
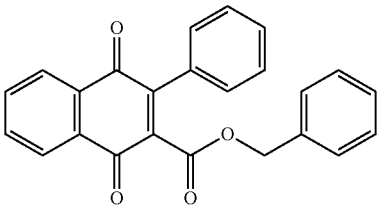
ET4:
[Chemical Formula 33]
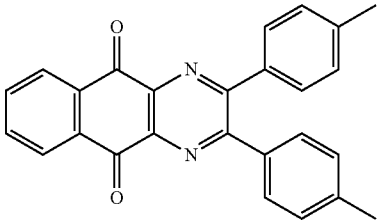
ET5:
[Chemical Formula 34]
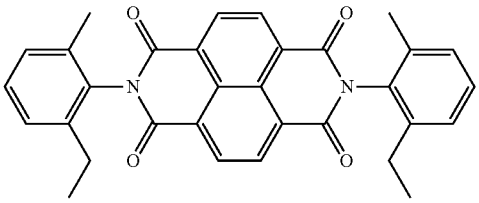

-continued

ET6:

[Chemical Formula 35]

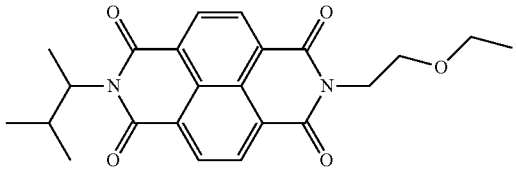

ET7:

[Chemical Formula 36]

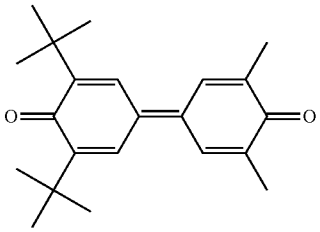

ET8:

[Chemical Formula 37]

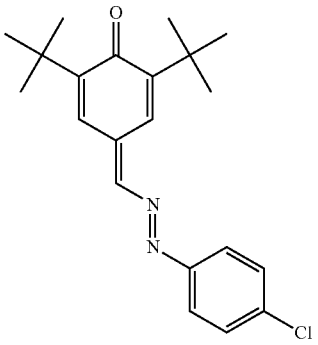

ET9:

[Chemical Formula 38]

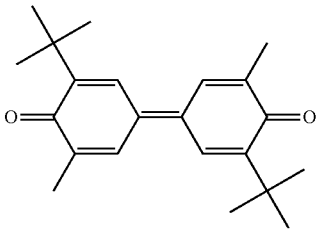

<Pigment of Comparative Example>

P1:

[Chemical Formula 39]

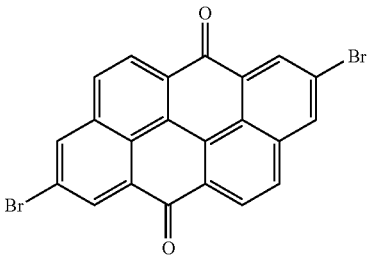

-continued

P2:

[Chemical Formula 40]

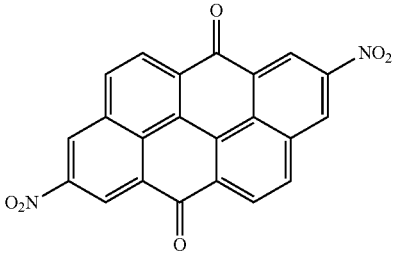

[Memory Confirmation Method]

<Measurement of Memory Potential>

Three sheets of blank paper, three sheets of solid paper, and three sheets of blank paper were subjected to continuous printing. The surface potential (V01) at the time of non-exposure (blank image) after the charging step and the surface potential (V02) in the charging step (blank image) subsequent to exposure (solid image) were measured, and the difference between the two was defined as an exposure memory potential (V01−V02). When the difference in exposure memory potential is less than 35 V, it is considered to be good. When the difference in exposure memory potential is 35 V or more, it is considered to be a problem.

<Image Evaluation>

The resulting electrophotographic photosensitive members were each mounted on a printer (FS-5300DN, manufactured by Kyocera Document Solutions Inc.) from which a charge-removing lamp had been detached, and a predetermined original for evaluating memory image (refer to FIG. 3 in Japanese Unexamined Patent Application Publication No. 2006-91488) was continuously printed on 10,000 sheets of A4 paper, and image evaluation was performed on the basis of the following criteria:

○: Generation of exposure memory in the grey portion is not or hardly observed visually.

x: Distinct generation of exposure memory in the grey portion is observed visually.

<Exposure Memory Evaluation>

The resulting electrophotographic photosensitive members were each mounted on a printer (FS-5300DN, manufactured by Kyocera Document Solutions Inc.) from which a charge-removing lamp had been detached. Then, charging was performed such that the surface potential was 800 V, and the exposure amount was adjusted such that the initial sensitivity of the solid portion was 150 V. The same original for evaluating memory image as that described above was continuously printed on 10,000 sheets of A4 paper, and image evaluation was performed on the basis of the following criteria:

○: Generation of exposure memory in the grey portion is not or hardly observed visually.

x: Distinct generation of exposure memory in the grey portion is observed visually.

TABLE 1

| | | | | N-type pigment | | | Memory | | |
|---|---|---|---|---|---|---|---|---|---|
| | CGM | HTM | ETM | Perylene-based | Azo-based | Others | Potential (V) | Image | Evaluation |
| Example 1 | CG4 | HT1 | ET1 | Perylene 1 | Azo 1 | None | 16 | ○ | ○ |
| Example 2 | CG4 | HT1 | ET1 | Perylene 1 | Azo 2 | None | 21 | ○ | ○ |
| Example 3 | CG4 | HT1 | ET1 | Perylene 1 | Azo 3 | None | 24 | ○ | ○ |
| Example 4 | CG4 | HT1 | ET1 | Perylene 1 | Azo 4 | None | 17 | ○ | ○ |
| Example 5 | CG4 | HT1 | ET1 | Perylene 1 | Azo 5 | None | 18 | ○ | ○ |
| Example 6 | CG4 | HT1 | ET1 | Perylene 1 | Azo 6 | None | 22 | ○ | ○ |
| Example 7 | CG4 | HT1 | ET1 | Perylene 1 | Azo 7 | None | 25 | ○ | ○ |
| Example 8 | CG4 | HT1 | ET1 | Perylene 1 | Azo 8 | None | 22 | ○ | ○ |
| Example 9 | CG4 | HT1 | ET1 | Perylene 2 | Azo 1 | None | 18 | ○ | ○ |
| Example 10 | CG4 | HT1 | ET1 | Perylene 3 | Azo 1 | None | 16 | ○ | ○ |
| Example 11 | CG4 | HT1 | ET1 | Perylene 4 | Azo 1 | None | 17 | ○ | ○ |
| Example 12 | CG4 | HT1 | ET1 | Perylene 5 | Azo 1 | None | 21 | ○ | ○ |
| Example 13 | CG4 | HT1 | ET1 | Perylene 6 | Azo 1 | None | 25 | ○ | ○ |
| Example 14 | CG4 | HT1 | ET1 | Perylene 7 | Azo 1 | None | 23 | ○ | ○ |
| Example 15 | CG4 | HT1 | ET1 | Perylene 8 | Azo 1 | None | 20 | ○ | ○ |
| Example 16 | CG1 | HT1 | ET1 | Perylene 1 | Azo 1 | None | 11 | ○ | ○ |
| Example 17 | CG2 | HT1 | ET1 | Perylene 1 | Azo 1 | None | 30 | ○ | ○ |
| Example 18 | CG3 | HT1 | ET1 | Perylene 1 | Azo 1 | None | 21 | ○ | ○ |
| Example 19 | CG5 | HT1 | ET1 | Perylene 1 | Azo 1 | None | 28 | ○ | ○ |
| Example 20 | CG4 | HT2 | ET1 | Perylene 1 | Azo 1 | None | 17 | ○ | ○ |
| Example 21 | CG4 | HT3 | ET1 | Perylene 1 | Azo 1 | None | 20 | ○ | ○ |
| Example 22 | CG4 | HT4 | ET1 | Perylene 1 | Azo 1 | None | 19 | ○ | ○ |
| Example 23 | CG4 | HT5 | ET1 | Perylene 1 | Azo 1 | None | 24 | ○ | ○ |
| Example 24 | CG4 | HT6 | ET1 | Perylene 1 | Azo 1 | None | 26 | ○ | ○ |
| Example 25 | CG4 | HT7 | ET1 | Perylene 1 | Azo 1 | None | 25 | ○ | ○ |
| Example 26 | CG4 | HT8 | ET1 | Perylene 1 | Azo 1 | None | 25 | ○ | ○ |
| Example 27 | CG4 | HT1 | ET2 | Perylene 1 | Azo 1 | None | 25 | ○ | ○ |
| Example 28 | CG4 | HT1 | ET3 | Perylene 1 | Azo 1 | None | 23 | ○ | ○ |
| Example 29 | CG4 | HT1 | ET4 | Perylene 1 | Azo 1 | None | 23 | ○ | ○ |
| Example 30 | CG4 | HT1 | ET5 | Perylene 1 | Azo 1 | None | 19 | ○ | ○ |
| Example 31 | CG4 | HT1 | ET6 | Perylene 1 | Azo 1 | None | 19 | ○ | ○ |
| Example 32 | CG4 | HT1 | ET7 | Perylene 1 | Azo 1 | None | 18 | ○ | ○ |
| Example 33 | CG4 | HT1 | ET8 | Perylene 1 | Azo 1 | None | 17 | ○ | ○ |
| Example 34 | CG4 | HT1 | ET9 | Perylene 1 | Azo 1 | None | 20 | ○ | ○ |
| Example 35 | CG4 | HT1 | ET9 | Perylene 1<br>0.2 | Azo 1<br>0.2 | None | 29 | ○ | ○ |
| Example 36 | CG4 | HT1 | ET9 | Perylene 1<br>3 | Azo 1<br>3 | None | 27 | ○ | ○ |

TABLE 2

| | | | | N-type pigment | | | Memory | | |
|---|---|---|---|---|---|---|---|---|---|
| | CGM | HTM | ETM | Perylene-based | Azo-based | Others | Potential (V) | Image | Evaluation |
| Comparative Example 1 | CG4 | HT1 | ET1 | None | None | None | 49 | X | X |
| Comparative Example 2 | CG4 | HT1 | ET1 | Perylene 1 | None | None | 38 | X | X |
| Comparative Example 3 | CG4 | HT1 | ET1 | Perylene 2 | None | None | 42 | X | X |
| Comparative Example 4 | CG4 | HT1 | ET1 | None | Azo 1 | None | 35 | X | X |
| Comparative Example 5 | CG4 | HT1 | ET1 | None | Azo 2 | None | 37 | X | X |
| Comparative Example 6 | CG2 | HT1 | ET1 | None | None | None | 61 | X | X |
| Comparative Example 7 | CG2 | HT1 | ET1 | Perylene 1 | None | None | 53 | X | X |
| Comparative Example 8 | CG2 | HT1 | ET1 | None | Azo 1 | None | 50 | X | X |
| Comparative Example 7 | CG2 | HT8 | E9 | Perylene 2 | None | None | 56 | X | X |
| Comparative Example 8 | CG4 | HT1 | ET1 | None | None | P1 | 47 | X | X |
| Comparative Example 9 | CG4 | HT1 | ET1 | None | None | P2 | 59 | X | X |
| Comparative Example 10 | CG4 | HT1 | ET1 | None | Azo 1 | P1 | 47 | X | X |
| Comparative Example 11 | CG4 | HT1 | ET1 | Perylene 1 | None | P1 | 49 | X | X |

TABLE 2-continued

| | | | | N-type pigment | | | Memory | | |
|---|---|---|---|---|---|---|---|---|---|
| | CGM | HTM | ETM | Perylene-based | Azo-based | Others | Potential (V) | Image | Evaluation |
| Comparative Example 12 | CG4 | HT1 | ET1 | Perylene 1 0.001 | Azo 1 0.001 | None | 49 | ○ | ○ |
| Comparative Example 13 | CG4 | HT1 | ET1 | Perylene 1 5.5 | Azo 1 5.5 | None | 48 | ○ | ○ |

In each of the Examples in which two N-type pigments including a perylene-based pigment and an azo-based pigment are combined for use, the exposure memory potential is small, and a good image with a small amount of exposure memory can be obtained. In contrast, in Comparative Examples 1, 6, 8, and 9 in which no N-type pigment is used and in Comparative Examples 2 to 5, 7, 10, and 11 in which only one N-type pigment, i.e., a perylene-based or azo-based pigment, is used, the exposure memory potential is large, and a memory phenomenon is observed in the image. Furthermore, as shown in Comparative Examples 12 and 13, even in the case where two N-type pigments are combined for use, when the content is out of the predetermined range, the exposure memory potential is large, and a memory phenomenon is observed in the image.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A single-layer-type electrophotographic photosensitive member comprising: a layer disposed on an electrically conductive substrate, the layer including at least a charge-generating material, an electron transport material, a hole transport material, and a binder resin within the same layer; and the charge-generating material contains a phthalocyanine pigment and N-type pigments including at least a perylene-based pigment and an azo-based pigment, and the total amount of the N-type pigments is 0.3 to 3 parts by mass relative to 1 part by mass of the phthalocyanine pigment.

2. The single-layer-type electrophotographic photosensitive member according to claim 1, wherein the azo-based pigment is selected from the group of chemical formulas consisting of chemical formula 6, chemical formula 7, chemical formula 8, chemical formula 9, chemical formula 10, chemical formula 11, chemical formula 12 and chemical formula 13:

[Chemical Formula 6]

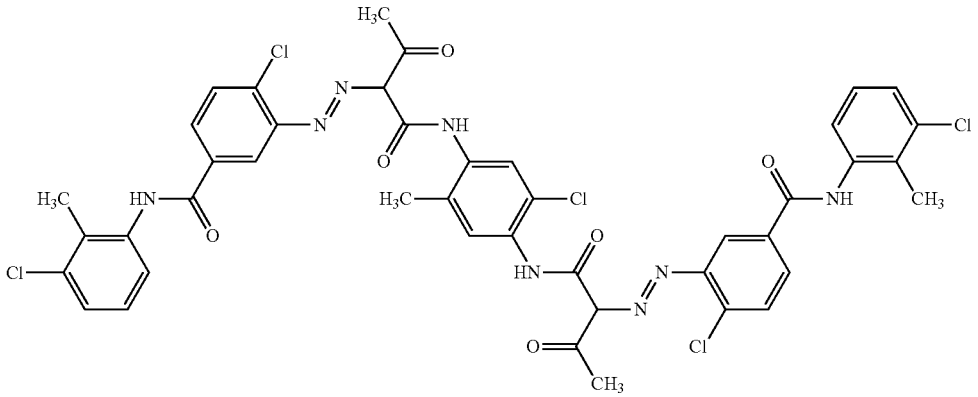

[Chemical Formula 7]

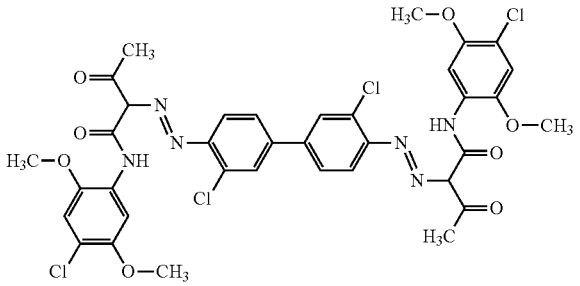

[Chemical Formula 8]

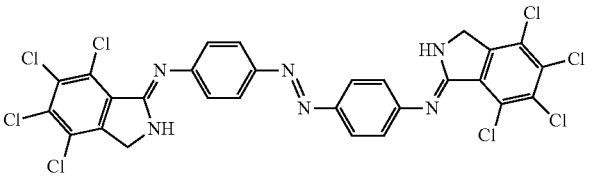

-continued
[Chemical Formula 9]
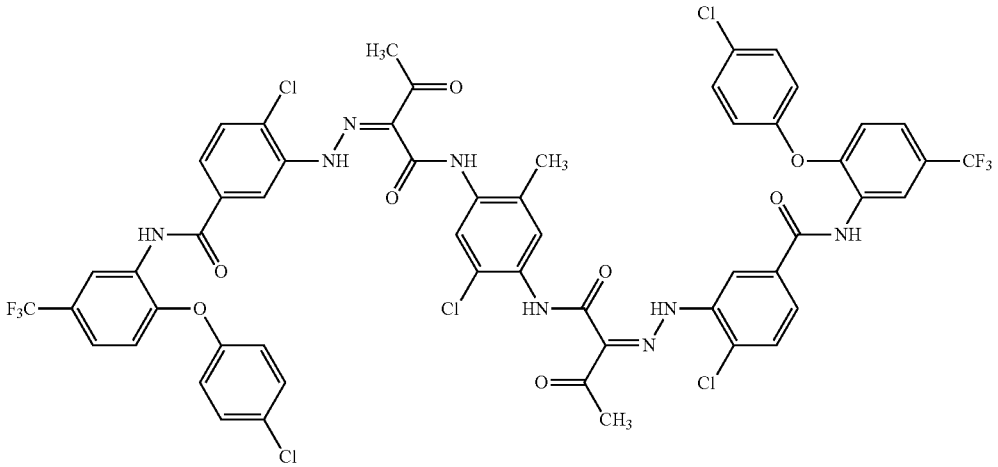
[Chemical Formula 10]
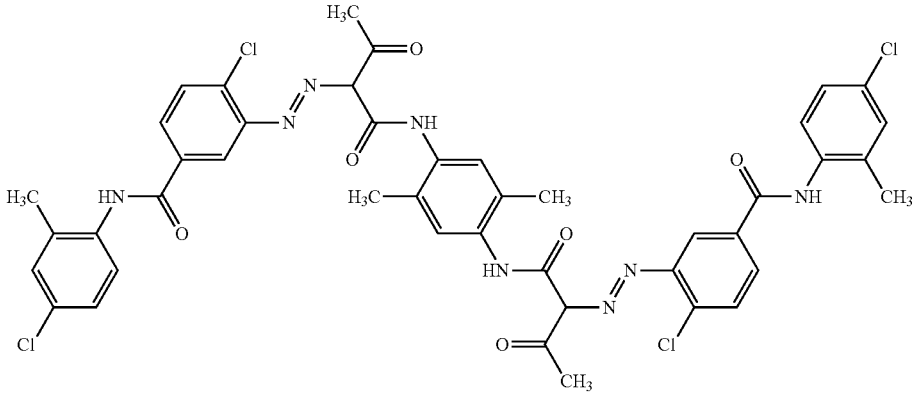
[Chemical Formula 11]
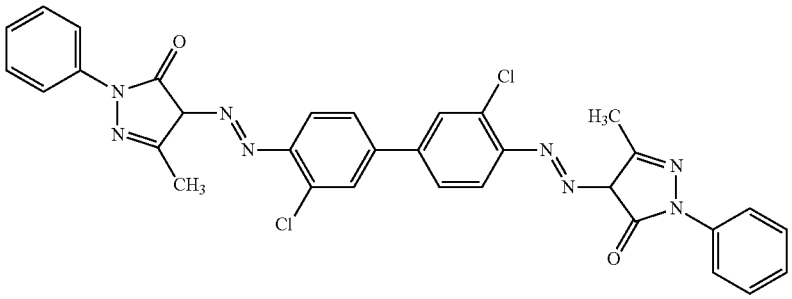
[Chemical Formula 12]
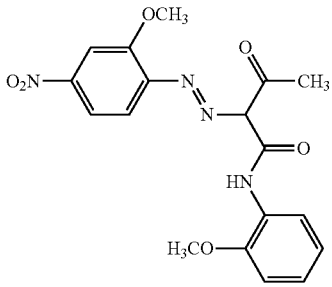
[Chemical Formula 13]
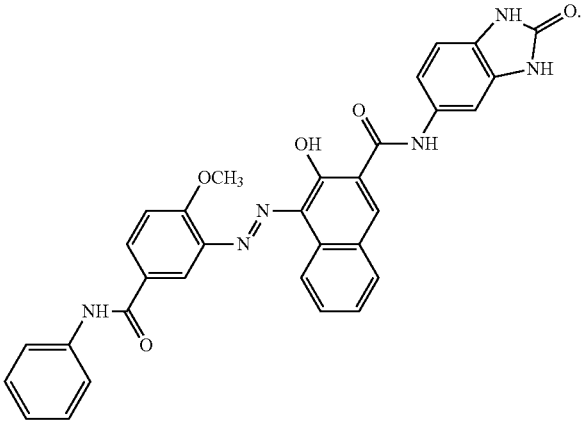

3. The single-layer-type electrophotographic photosensitive member according to claim 1, wherein the perylene-based pigment is selected from the following group of chemical formulas consisting of chemical formula 14, chemical formula 15, chemical formula 16, chemical formula 17, chemical formula 18, chemical formula 19, chemical formula 20 and chemical formula 21:

[Chemical Formula 14]

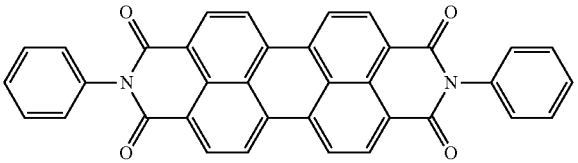

[Chemical Formula 15]

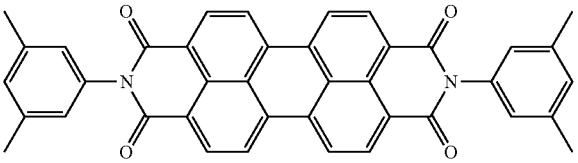

[Chemical Formula 16]

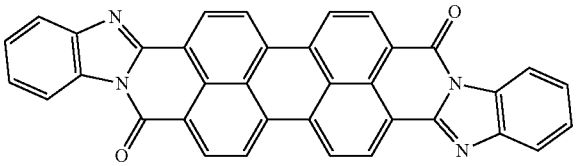

[Chemical Formula 17]

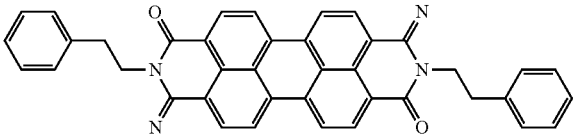

[Chemical Formula 18]

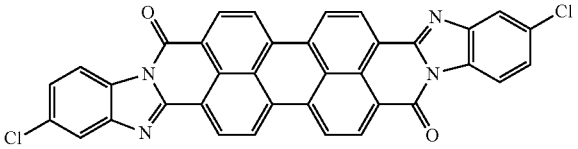

-continued

[Chemical Formula 19]

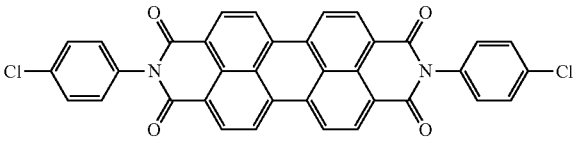

[Chemical Formula 20]

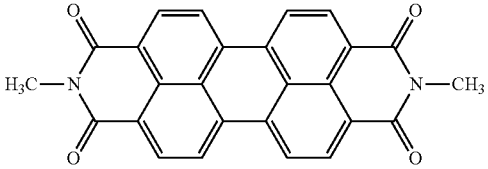

[Chemical Formula 21]

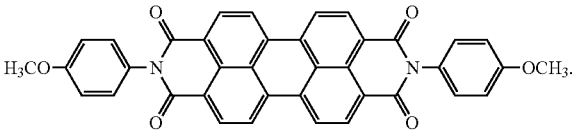

4. The single-layer-type electrophotographic photosensitive member according to claim 3, wherein the azo-based pigment is selected from the chemical formula 6, chemical formula 7, chemical formula 8, chemical formula 9, chemical formula 10, chemical formula 11, chemical formula 12 and chemical formula 13.

5. The single-layer-type electrophotographic photosensitive member according to claim 4, wherein the hole transport material is selected from the group of chemical formulas consisting of chemical formula 22, chemical formula 23, chemical formula 24, chemical formula 25, chemical formula 26, chemical formula 27, chemical formula 28 and chemical formula 29:

[Chemical Formula 22]

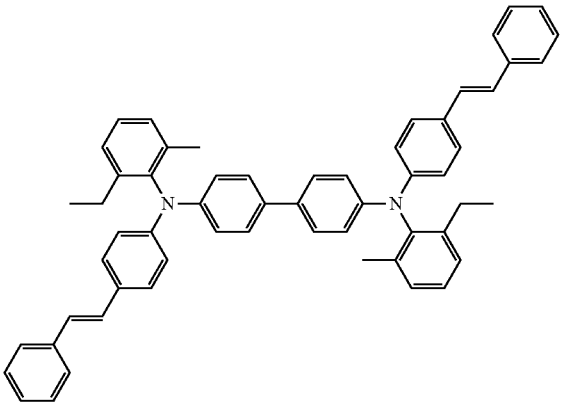

[Chemical Formula 23]

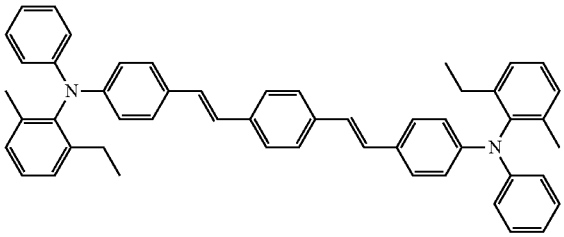

-continued
[Chemical Formula 24]
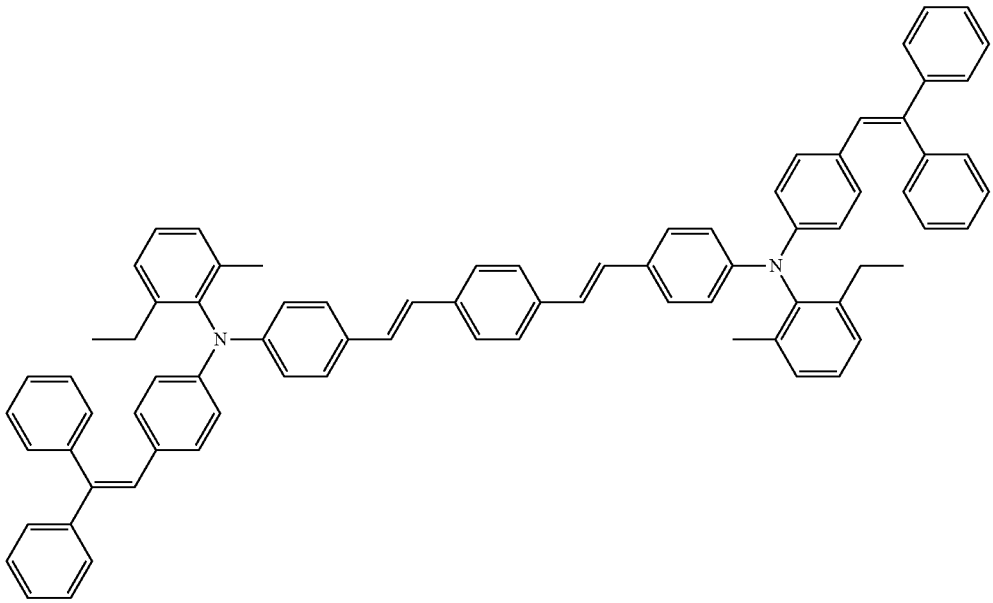
[Chemical Formula 25]
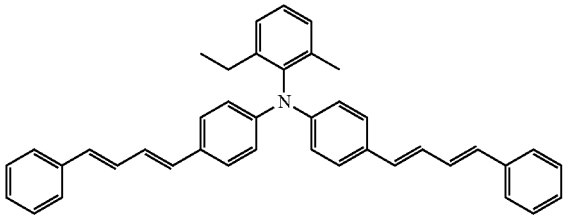
[Chemical Formula 26]
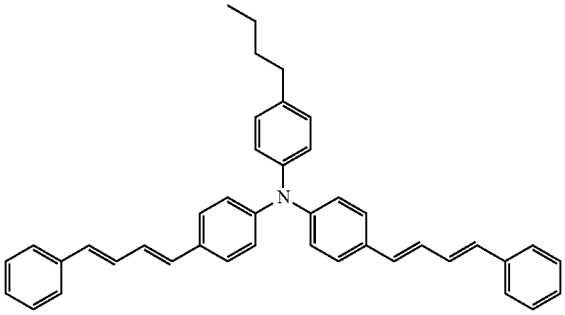
[Chemical Formula 27]
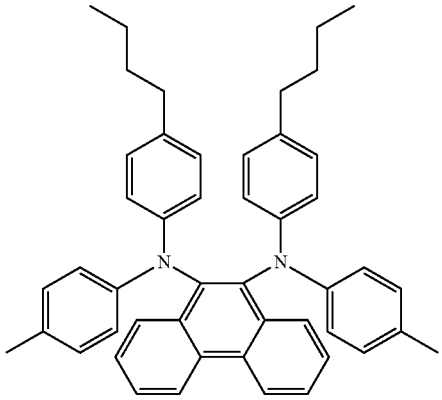
[Chemical Formula 28]
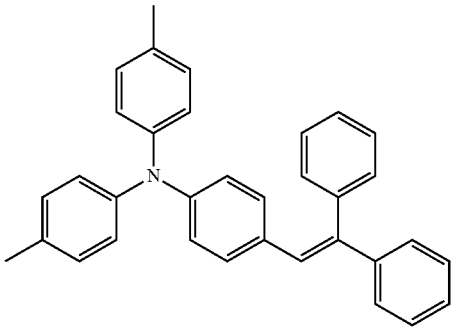
[Chemical Formula 29]
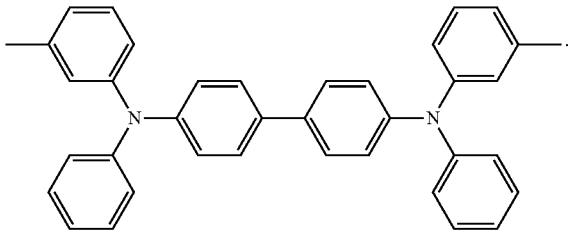

6. The single-layer-type electrophotographic photosensitive member according to claim 5, wherein the electron transport material is selected from the group of chemical formulas consisting of chemical formula 30, chemical formula 31, chemical formula 32, chemical formula 33, chemical formula 34, chemical formula 35, chemical formula 36, chemical formula 37 and chemical formula 38:

[Chemical Formula 30]

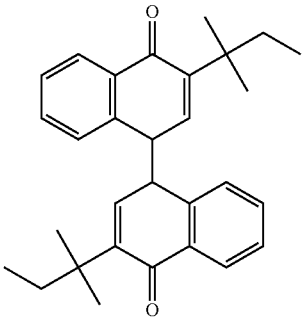

[Chemical Formula 31]

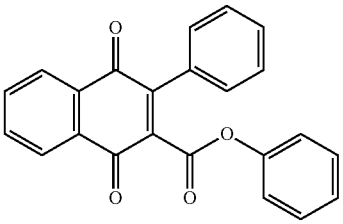

[Chemical Formula 32]

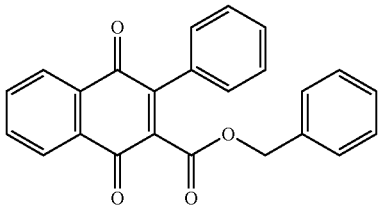

[Chemical Formula 33]

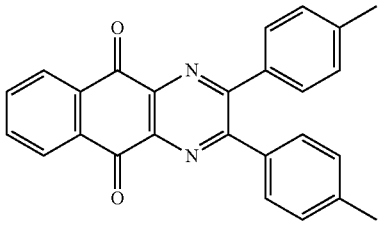

[Chemical Formula 34]

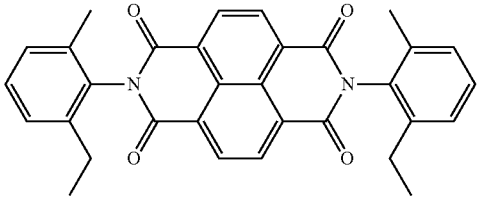

-continued

[Chemical Formula 35]

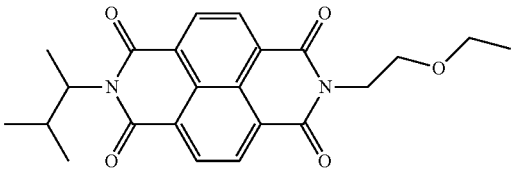

[Chemical Formula 36]

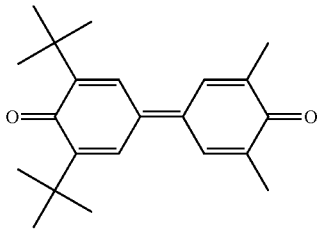

[Chemical Formula 37]

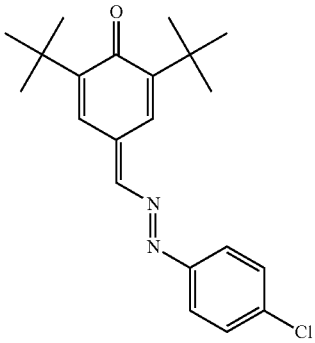

[Chemical Formula 38]

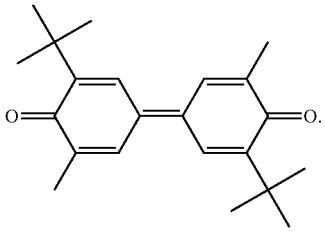

7. An image forming apparatus comprising:

an image-supporting member;

a charging device for charging a surface of the image-supporting member;

an exposing device for exposing the charged surface of the image-supporting member and forming an electrostatic latent image on the surface of the image-supporting member;

a developing device for developing the electrostatic latent image on the surface of the image-supporting member to form a toner image; and a transferring device for transferring the toner image from the image-supporting member to a transfer-receiving medium, the image-supporting member is a single-layer-type electrophotographic photosensitive member comprising a layer disposed on an electrically conductive substrate, the layer including at least a charge-generating material, an electron transport material, a hole transport material, and a binder resin within the same layer; and the charge-generating material contains a phthalocyanine pigment and N-type pigments including at least a perylene-based pigment and an azo-based pigment, and the total amount of the N-type pigments is 0.3 to 3 parts by mass relative to 1 part by mass of the phthalocyanine pigment, and the charging device positively charges the image-supporting member.

8. The image forming apparatus according to claim 7, wherein the apparatus does not include a charge-removing device.

* * * * *